US006732710B2

(12) United States Patent
Borean et al.

(10) Patent No.: US 6,732,710 B2
(45) Date of Patent: May 11, 2004

(54) INTERNAL-COMBUSTION ENGINE WITH TWO INLET VALVES FOR EACH CYLINDER AND AN ELECTRONICALLY CONTROLLED SYSTEM FOR ACTUATING THE INLET VALVES IN DIFFERENTIATED AND ALTERNATING WAYS

(75) Inventors: Fabio Borean, Moncalieri (IT); Lorenzo Chiosi, Figline Valdarno (IT)

(73) Assignee: C.R.F. Societa Consortile per Azioni, Turin (IT)

( * ) Notice: Subject to any disclaimer, the term of this patent is extended or adjusted under 35 U.S.C. 154(b) by 0 days.

(21) Appl. No.: 10/439,187

(22) Filed: May 16, 2003

(65) Prior Publication Data

US 2004/0000287 A1 Jan. 1, 2004

(30) Foreign Application Priority Data

Jul. 1, 2002 (IT) ..... TO2002A000571

(51) Int. Cl.[7] ..... F01L 1/34
(52) U.S. Cl. ..... 123/432; 123/90.12; 123/90.16
(58) Field of Search ..... 123/432, 90.12, 123/90.16

(56) References Cited

U.S. PATENT DOCUMENTS

| | | | | | |
|---|---|---|---|---|---|
| 5,036,807 | A | * | 8/1991 | Kaneko | 123/90.16 |
| 5,301,636 | A | * | 4/1994 | Nakamura | 123/90.16 |
| 5,836,274 | A | * | 11/1998 | Saito et al. | 123/90.16 |
| 6,173,685 | B1 | * | 1/2001 | Sturman | 123/90.12 |
| 6,394,053 | B2 | * | 5/2002 | Shin | 123/90.45 |
| 6,550,434 | B2 | * | 4/2003 | Leone et al. | 123/90.15 |

* cited by examiner

*Primary Examiner*—Erick Solis
(74) *Attorney, Agent, or Firm*—Sughrue Mion, PLLC

(57) ABSTRACT

An internal-combustion engine with two inlet valves for each cylinder is provided with an electronically controlled system for actuating said valves. The electronic control unit is programmed so as to control in a differentiated way the two inlet valves according to a first law of opening and closing and a second law of opening and closing, which are different from one another. The electronic control means are moreover designed for reversing with respect to one another the laws of opening and closing of the two inlet valves at each operating cycle of the engine or else with a periodicity equal to more than one operating cycle of the engine, so that each of the two inlet valves alternately follows the first law and the second law of opening and closing.

3 Claims, 4 Drawing Sheets

INTERNAL-COMBUSTION ENGINE WITH TWO INLET VALVES FOR EACH CYLINDER AND AN ELECTRONICALLY CONTROLLED SYSTEM FOR ACTUATING THE INLET VALVES IN DIFFERENTIATED AND ALTERNATING WAYS

BACKGROUND OF THE INVENTION

The present invention relates to internal-combustion engines of the type with at least two inlet valves for each cylinder and an electronically controlled hydraulic system for variable actuation of the inlet valves.

The present applicant has already proposed in the U.S. Pat. No. 6,237,551 an engine comprising:

- at least two inlet valves for each cylinder, each provided with respective elastic-return means, which push the valve towards a closed position, for controlling respective induction and exhaust ducts;
- at least one camshaft for actuating each inlet valve of the cylinders of the engine by means of respective tappets, each inlet valve being controlled by a respective cam of said camshaft,
  - in which each of said tappets controls the respective inlet valve against the action of said elastic-return means by the interposition of hydraulic means, which include a pressurized fluid chamber,
  - the pressurized fluid chamber associated to each inlet valve being designed for being connected by means of a solenoid valve to an -exhaust duct for the purpose of uncoupling the valve from the respective tappet and causing rapid closing of the valve as a result of the respective elastic-return means; and
- electronic control means for controlling each solenoid valve for varying the time and stroke of opening of the respective inlet valve or exhaust valve according to one or more operating parameters of the engine.

The present applicant has also already proposed in the Italian patent application T02001A000660, dated Jul. 6, 2001 (still secret at the date of filing of the present patent application), an engine of the type specified above, in which the inlet valves associated to each cylinder are controlled in a differentiated way in time and/or in the extent of opening, so that a first inlet valve follows a first law of opening and closing, whilst a second inlet valve follows a second law of opening and closing.

Independently of the solution previously proposed, controlling in a differentiated way opening and closing of the two inlet valves of each cylinder may be useful for any other reason. Obviously, in the case of differentiated control, it follows that the parts of the system associated to the two inlet valves are subject to different stresses, which result in a substantial intrinsic asymmetry of the system.

The purpose of the present invention is to overcome the above drawback, guaranteeing a uniform stress on the systems for actuating the two inlet valves of each cylinder.

SUMMARY OF THE INVENTION

In order to achieve the above purpose, the subject of the invention is an engine which has all the characteristics referred to at the start and which is further characterized in that the two inlet valves associated to each cylinder are controlled in a differentiated way in time and/or in extent of opening, so that at each engine cycle an inlet valve follows a first law of opening and closing, whilst the other inlet valve follows a second law of opening and closing, and in that the aforesaid electronic control means are programmed for reversing with respect to one another the laws of opening and closing of the two inlet valves of the same cylinder with a periodicity equal to one or more engine cycles, so that each of the two inlet valves follows alternately the first law or the second law of opening and closing at each successive period.

BRIEF DESCRIPTION OF THE DRAWINGS

Further characteristics and advantages of the invention will emerge clearly from the ensuing description with reference to the annexed drawings, which are provided purely by way of non-limiting example and in which.

DETAILED DESCRIPTION OF THE INVENTION

Figure 1:
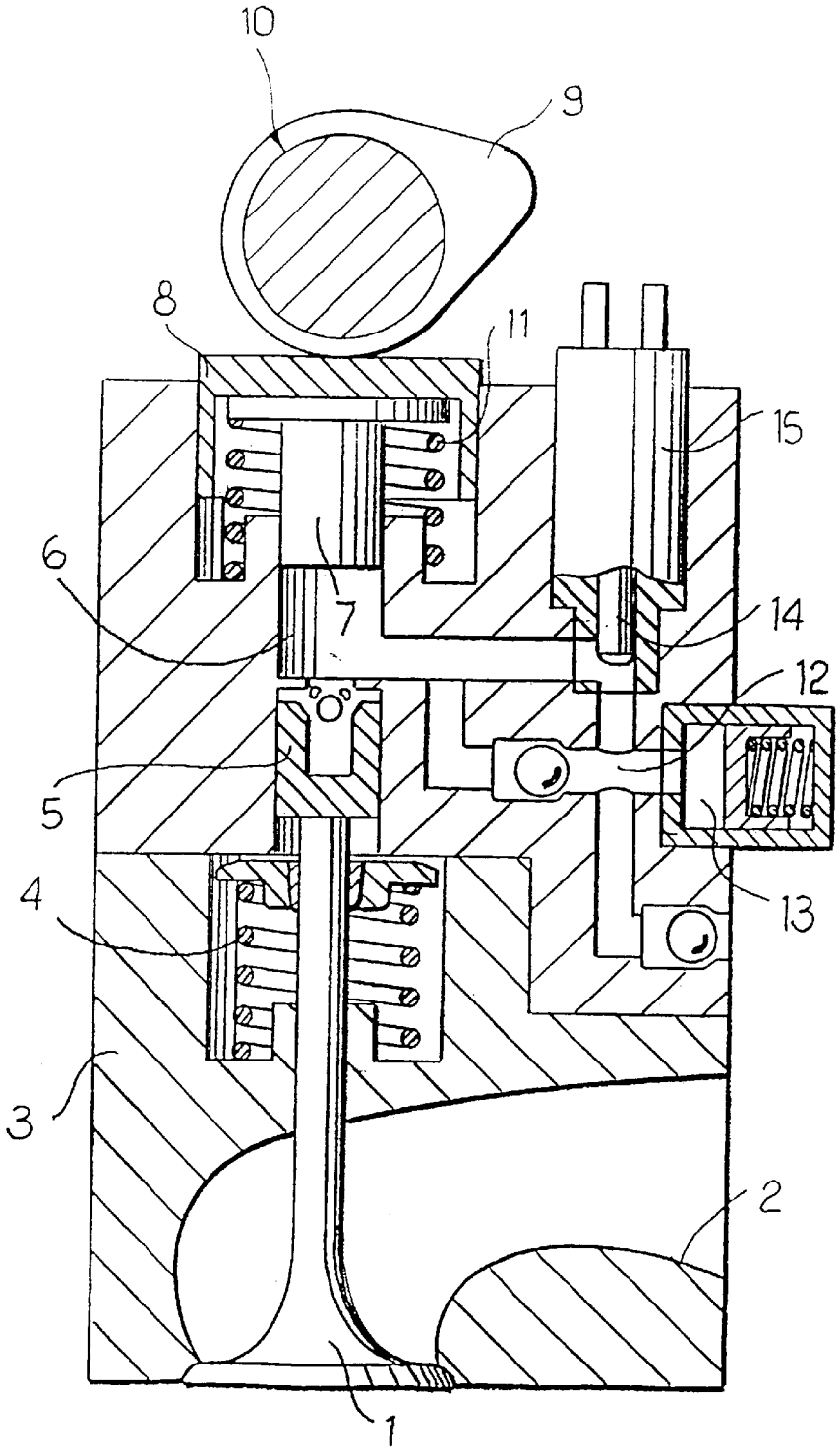
FIG. 1 is a schematic view illustrating the principle of operation of a system for variable actuation of valves in an internal-combustion engine.

FIG. 1 is a schematic illustration of the principle of operation of a system for variable actuation of the valves in an internal-combustion engine. The reference number 1 designates as a whole the valve (which can be either an inlet valve, or an exhaust valve) associated to a respective duct 2 (either induction or exhaust) formed in a cylinder head 3 of an internal-combustion engine. The valve 1 is recalled towards its closed position (upwards, as viewed in FIG. 1) by a spring 4, whilst it is forced to open by a piston 5, which acts on the top end of the stem of the valve. The piston 5 is in turn controlled, via oil under pressure which is present inside a chamber 6, by a piston 7, which supports a tappet bucket 8 co-operating with a cam 9 of a camshaft 10. The bucket 8 is withheld, by a spring 11, in slidable contact with the cam 9. The pressure chamber 6 can be connected to a duct 12, which in turn communicates with a pressure accumulator 13, through the open/close element 14 of a solenoid valve 15, which is controlled by electronic control means (not illustrated) according to the conditions of operation of the engine. When the solenoid valve 15 is open, the oil under pressure, which is present in the chamber 6, is discharged, so that the valve 1 closes rapidly under the action of the elastic-return spring 4.

When the solenoid valve 15 is closed, the oil present in the chamber 6 transmits the movements of the piston 7 to the piston 5 and consequently to the valve 1, so that the position of the valve 1 is determined by the cam 9. In other words, the cam 9 normally controls opening of the valve 1 according to a cycle which depends upon by the profile of the cam, but it can be "disabled" whenever required, by opening the solenoid valve 15, so as to interrupt the connection between the piston 7 and the valve 1.

The present invention relates to the application of a system of variable actuation of the valves of the type described above to an engine in which associated to each cylinder are two inlet valves.

Figure 2:
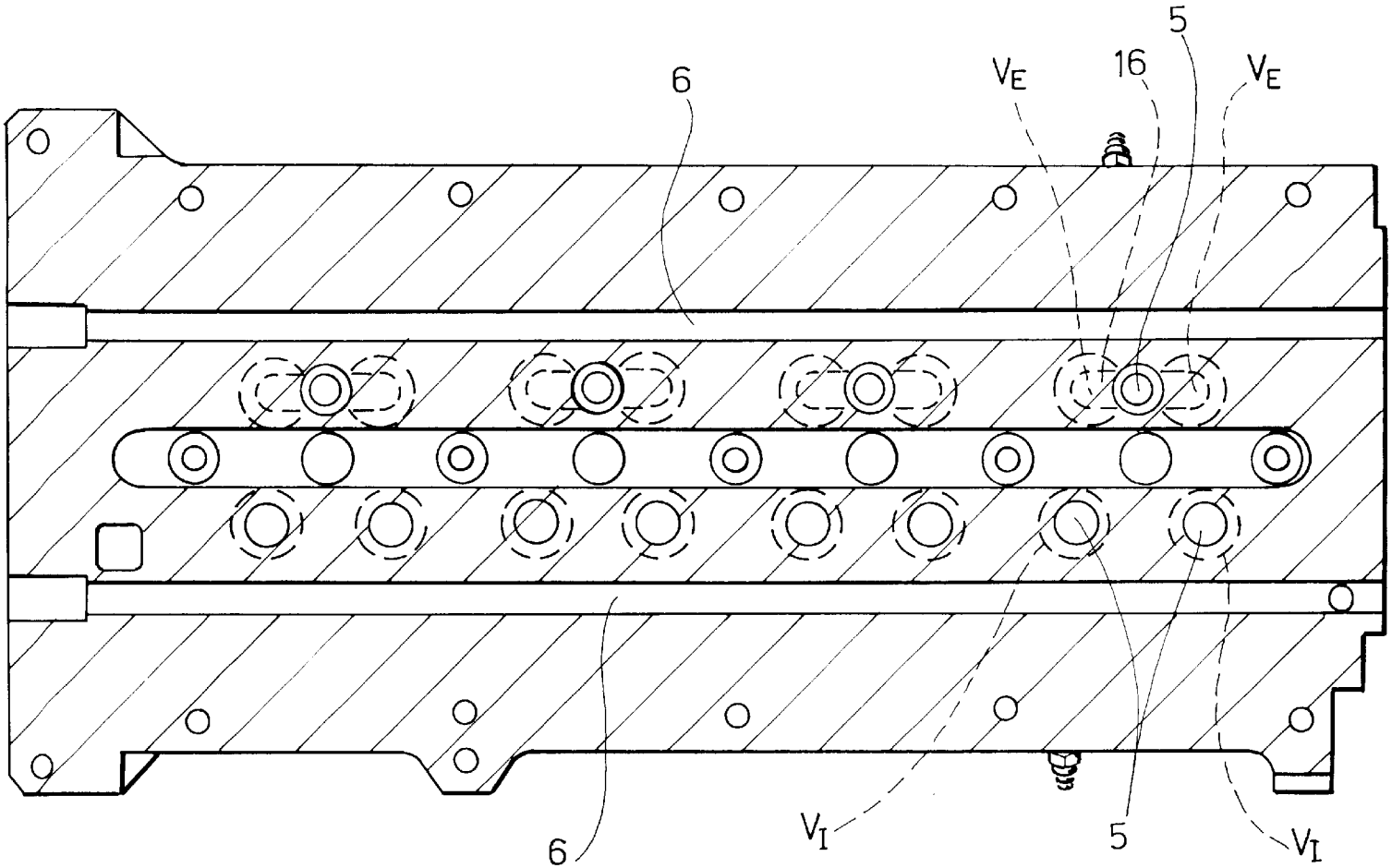
FIG. 2 is a cross-sectional view in a plane normal to the axis of the cylinders of a cylinder head of an internal-combustion engine according to the invention.

FIG. 2 illustrates a cross-sectional view, in a plane perpendicular to the axes of the cylinders, of the cylinder head of an example of embodiment of the engine according to the invention. For each cylinder, the engine envisages two inlet valves $V_I$ and two exhaust valves $V_E$. Each pair of exhaust valves $V_E$ are controlled, in the case of the specific example illustrated, via a link 16, by a single actuator piston 5 (even though it would obviously be possible to provide two distinct actuators for the two exhaust valves or else not to envisage at all electronic control for controlling the exhaust valves), whilst the two inlet valves of each cylinder $V_I$ are controlled by separate actuator pistons 5.

Figure 3:
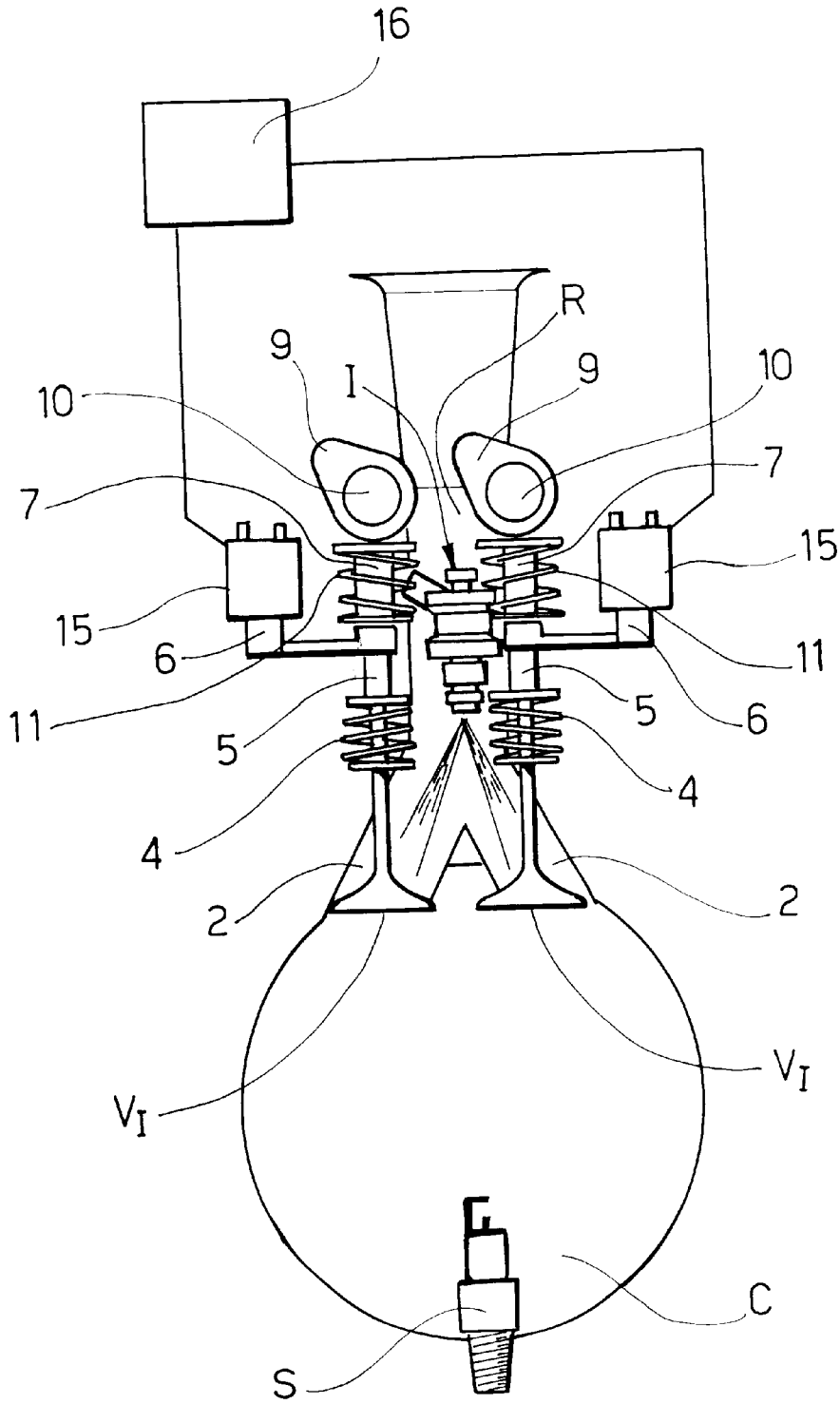
FIG. 3 is a schematic view of a cylinder of the engine with the two inlet valves and the corresponding systems of actuation associated thereto.

FIG. 3 is a schematic view of a cylinder of the engine according to the invention. In FIG. 3, the parts corresponding to the ones illustrated in FIG. 1 are designated by the same reference numbers. As may be seen, the system has, in practice, a configuration doubled with respect to the one illustrated in FIG. 1. The two inlet valves VI are in fact controlled by respective cams 9 of a camshaft 10. Each cam 9 controls a respective tappet 7, associated to which is a respective actuator 5, according to the configuration illustrated in FIG. 1. The two pressurized chambers 6 are controlled by two respective solenoid valves 15, which are in turn controlled by an electronic control unit 16. The two valves VI control the inflow of air by means of two respective inlet ducts 2 inside the combustion chamber associated to a cylinder C of the engine, in which there is set a spark plug S. The two inlet ducts 2 branch off from a single inlet duct R, in which there is set an electronically controlled petrol-injecting device I.

Figure 4:
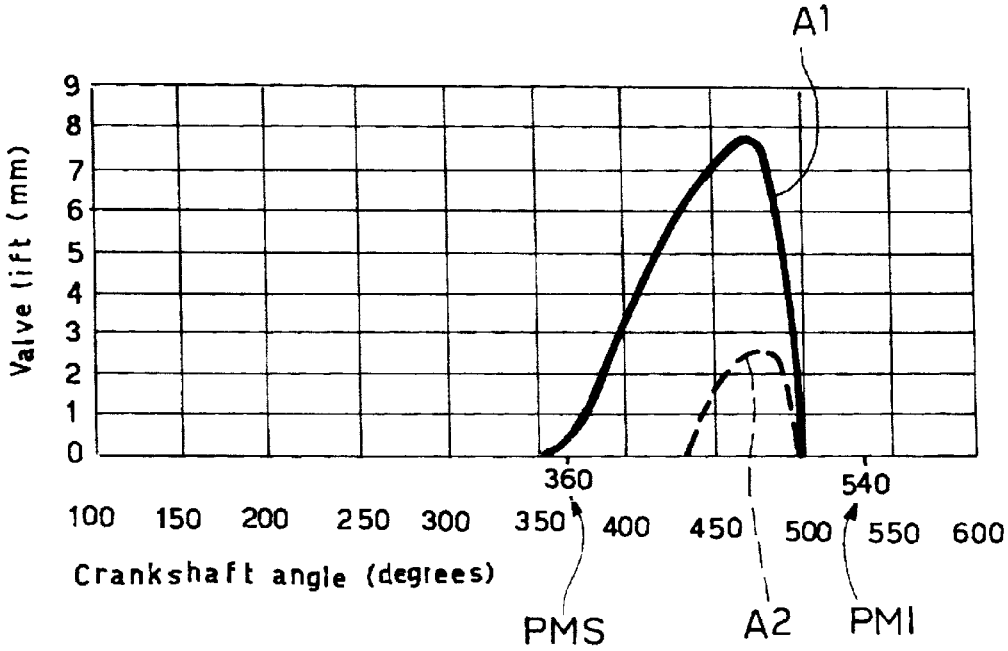
FIGS. 4 and 5 are two diagrams which illustrate the principle of operation of the engine according to the invention.

FIG. 4 illustrates the cycle of opening and closing of the two inlet valves in an operating cycle of the engine. The diagram of FIG. 4 shows the lift of each of the two inlet valves (in this case designated by A1 and A2) according to the rotation of the engine shaft. The diagram also illustrates the positions of the engine shaft corresponding to the top dead centre (TDC) and the bottom dead centre (BDC). As may be seen in the case of FIG. 4, the two inlet valves A1, A2 are controlled according to a different law of opening and closing. In the case of the valve A1, the lift is greater and is generated for a larger angular range, whilst in the case of the valve A2 the lift is smaller and is generated for a smaller angular range. In both cases, the valve-lift diagram is different from the theoretical one corresponding to the geometry of the cam for controlling the valve, in so far as, in particular in the valve-closing step, the valve is closed more rapidly (i.e., in a more restricted angular range) as compared to what would occur as a result of the geometry of the control cam.

Figure 5:
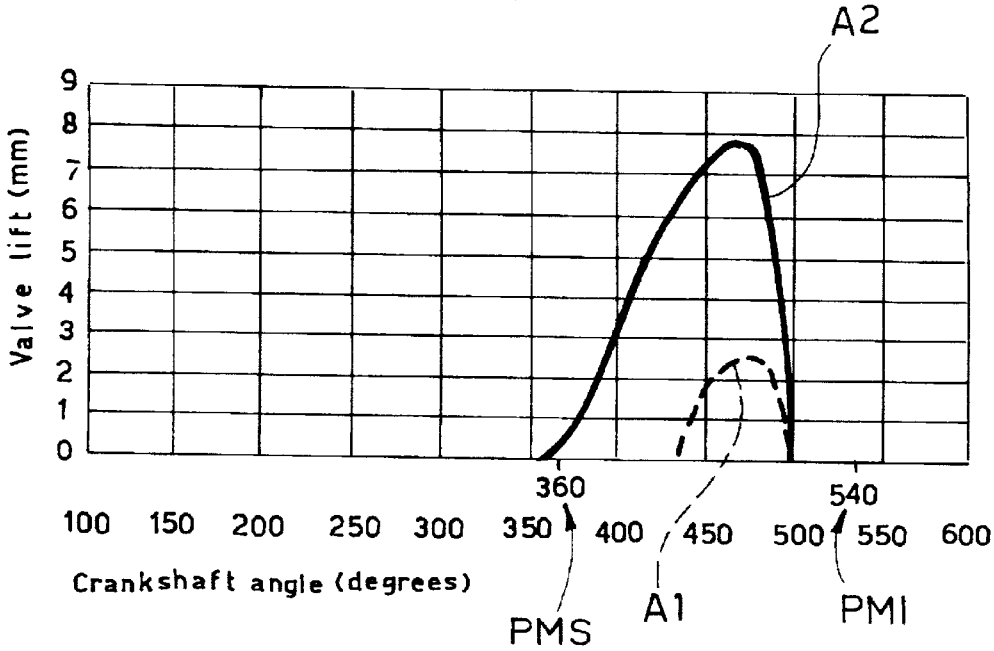

According to the present invention, in addition to controlling the two inlet valves A1, A2 in a differentiated way, according to a first law of opening and closing and a second law of opening and closing, it is also envisaged that at each successive operating cycle of the engine the differentiation between the two valves will be reversed, in the sense that if in the preceding cycle a first inlet valve has been controlled according to a first law and a second inlet valve has been controlled according to a second law, in the subsequent operating cycle of the engine said control is reversed, so that the first valve is controlled according to the second law and the second valve is controlled according to the first law. In practice, each inlet valve is controlled alternately according to the first law of opening and closing and according to the second law of opening and closing at each successive engine cycle. For example, FIG. 5 illustrates the diagram of the lifts of the two valves A1, A2 in any cycle subsequent to a cycle of the type illustrated in FIG. 4. As may be seen, the diagram of FIG. 5 is identical to that of FIG. 4, but in this case the line with greater lifts refers to the valve A2, whilst the line with smaller lifts refers to the valve A1.

Thanks to the aforesaid solution, the advantages deriving from the differentiated control of the two inlet valves are maintained, without introducing any asymmetry in the type of stress to which the mechanical and hydraulic members associated to the two inlet valves are subjected.

The aforesaid solution guarantees a wear and an ageing that are potentially uniform on all the actuators for controlling the inlet valves, minimizes the di-symmetrical effect of the dispersions present on the components on each actuator of each cylinder, and enables also selective activation and de-activation of the inlet valves aimed at a reduction in the levels of absorption of the actuator, combined with an increase in the turbulence induced in the combustion chamber.

The solution also enables recognition of any malfunctioning on one of the two valves of each cylinder, since the control over each valve is different from the other, and since a periodic reversal of the controls is envisaged, with an effect that is assumed as being imperceptible in the air taken in.

Of course, the reversal of the laws of opening and closing of the two inlet valves of each cylinder can be obtained both at each successive operating cycle of the engine and also after a pre-determined number of operating cycles of the engine. In practice, that is, the periodicity of the reversal may correspond to one or even more operating cycles of the engine.

Of course, without prejudice to the aforesaid principle, the embodiments and details of construction may vary widely with respect to what is described and illustrated herein purely by way of example, without thereby departing from the scope of the present invention.

What is claimed is:

1. An internal combustion engine, comprising:

at least two inlet valves for each cylinder of the engine, each provided with respective elastic return means, which push the valve towards a closed position, for controlling respective inlet ducts and exhaust ducts;

at least one camshaft for actuating each inlet valve of the cylinders of the engine by means of respective tappets, each inlet and exhaust valve being controlled by a respective cam of said camshaft, in which each of said tappets controls the respective inlet valve against the action of said elastic return means by means of the interposition of hydraulic means, which include a pressurized fluid chamber, the pressurized fluid chamber associated to each inlet valve being designed for being connected, by means of a solenoid valve, to an exhaust duct for the purpose of uncoupling the valve from the respective tappet and causing rapid closing of the valve as a result of the respective elastic-return means; and electronic control means for controlling each solenoid valve for varying the time and the stroke of opening of the respective inlet or exhaust valve according to one or more operating parameters of the engine, wherein the two inlet valves associated to each cylinder are controlled in a differentiated way in time and/or in extent of opening, so that at each engine cycle an inlet valve follows a first law of opening and closing, whilst the other inlet valve follows a second law of opening and closing, and in that the aforesaid electronic control means are programmed for reversing with respect to one another the laws of opening and closing of the two inlet valves of the same cylinder with a periodicity equal to one or more operating cycles of the engine, so that each of the two inlet valves alternately follows the first law and the second law of opening and closing at each successive period.

2. The engine according to claim 1, wherein the aforesaid electronic control means are designed for reversing with respect to one another the laws of opening and closing of the two inlet valves of the same cylinder at each operating cycle of the engine.

3. The engine according to claim 1, wherein it is a petrol engine, and in that the two aforesaid inlet ducts branch off from a common duct, in which an electronically controlled petrol-injecting device is provided.

* * * * *